United States Patent [19]

Abramson

[11] Patent Number: 5,049,725

[45] Date of Patent: Sep. 17, 1991

[54] HINGEABLE RADIANT HEATING STRUCTURE

[75] Inventor: Andrew E. Abramson, Excelsior, Minn.

[73] Assignee: Research, Incorporated, Eden Prairie, Minn.

[21] Appl. No.: 537,900

[22] Filed: Jun. 13, 1990

[51] Int. Cl.[5] ..... F26B 3/30

[52] U.S. Cl. ..... 219/347; 392/420; 392/423

[58] Field of Search ..... 219/347, 350–352, 219/354, 357, 343, 377; 362/218, 219, 255, 220, 92; 392/412, 413, 420, 423

[56] References Cited

U.S. PATENT DOCUMENTS

| | | | |
|---|---|---|---|
| 1,514,287 | 11/1924 | Hynes | 219/537 |
| 2,590,417 | 3/1952 | Jones | 219/349 |
| 2,627,014 | 1/1953 | Kolb | 219/349 |
| 2,917,616 | 12/1959 | Thomson | 219/351 |
| 3,021,422 | 2/1962 | Ogier et al. | 362/218 |
| 3,371,187 | 2/1968 | Volker | 219/347 |
| 3,986,018 | 10/1976 | Ishii | 362/218 |
| 4,591,697 | 5/1986 | Lexer | 219/348 |

FOREIGN PATENT DOCUMENTS

| | | | |
|---|---|---|---|
| 635749 | 1/1962 | Canada | 219/347 |

*Primary Examiner*—Bruce A. Reynolds
*Assistant Examiner*—John A. Jeffery
*Attorney, Agent, or Firm*—Kinney & Lange

[57] ABSTRACT

A radiant heating structure having a formed first sheet and a pair of reflectors therein removably postioned so as to be hingeable with another similar radiant heating structure. A pair of radiant energy tube holders are positioned within the formed sheet at opposite ends of the reflectors.

26 Claims, 6 Drawing Sheets

HINGEABLE RADIANT HEATING STRUCTURE

BACKGROUND OF THE INVENTION

The present invention relates to radiant heaters and, more particularly, to multiple radiant heaters.

Radiant heating units have a wide range of uses from paint drying to shrinking heat-shrinkable tubes over wiring bundles or the like. In uses involving the drying of coatings on surfaces like paint, the surfaces are often substantial in extent or they are complex in shape, or both. Adequate drying of the entire extent of an expansive surface, or of all of the valleys and niches in a complicated surface, often requires the concurrent use of many such radiant heating units.

The use of multiple radiant heaters has often required extensive framing to be provided around the space in which the heating is to take place to thereby provide suitable mounting for such units. If a new shape is to be heated requiring a correspondingly reshaped heating space, such framing is often not usable in its original form and must often be substantially altered or replaced entirely to once again provide the radiant heating units to be used in the proper positions. These framing alterations and remounting of radiant heating units can be both time consuming and expensive, as is the complete replacement of the previous framing if necessary.

Often too, the change in shape provided by a new object is accompanied by some other changes which require a change in the wavelength of the infrared radiation being provided by the radiant energy heaters for optimum results. Thus, there will be a corresponding desire to change the radiation element in each of the radiant heating units, and to do so with as little effort as possible. In addition, the reflectors typically used in the heating element may also need to be changed.

Such changes in the heating units themselves have in the past also not been easily accomplished and many times have required obtaining replacement heating units. Thus, there is a desire to have a radiant heating unit for use in multiples where the assemblage of the multiple units can be easily relocated in spatial position and easily reconfigured in relative position to one another, as well as having their radiant elements and reflective elements easily changed.

SUMMARY OF THE INVENTION

The present invention provides a radiant heating structure for supplying radiant energy to selected objects having a first frame with a first sheet that has inner and outer surfaces on opposite sides thereof which forms a channel space at the outer surface at a channel enclosure portion of the sheet and a source space at the inner surface between side edges of that sheet. A pair of reflectors are removably positioned in the source space each between a corresponding one of the first sheet side edges and the channel enclosure portion, the reflectors in this way forming a radiant energy reflecting surface facing outward between the two side edges. A pair of radiant energy tube holders are positioned in the source space at opposite ends of the first sheet to constrain radiant energy tubes if mounted therein. A pivot is secured to each of the side edges so that a further sheet of a second frame can be joined in common with the first sheet means about such a pivot. These frames can be held at a selected angle with respect to each other by end plates or by struts fastened to these sheets. Electrical terminals in the radiant energy tube holders are adapted to be connected to sources of voltage by wires in the channel space reaching those terminals. The channel space can also be pressurized to cause a pressurized gaseous coolant to escape through perforations in the channel enclosure portion into the source space and by the reflectors to cool them.

DETAILED DESCRIPTION OF THE PREFERRED EMBODIMENTS

Figure 1:
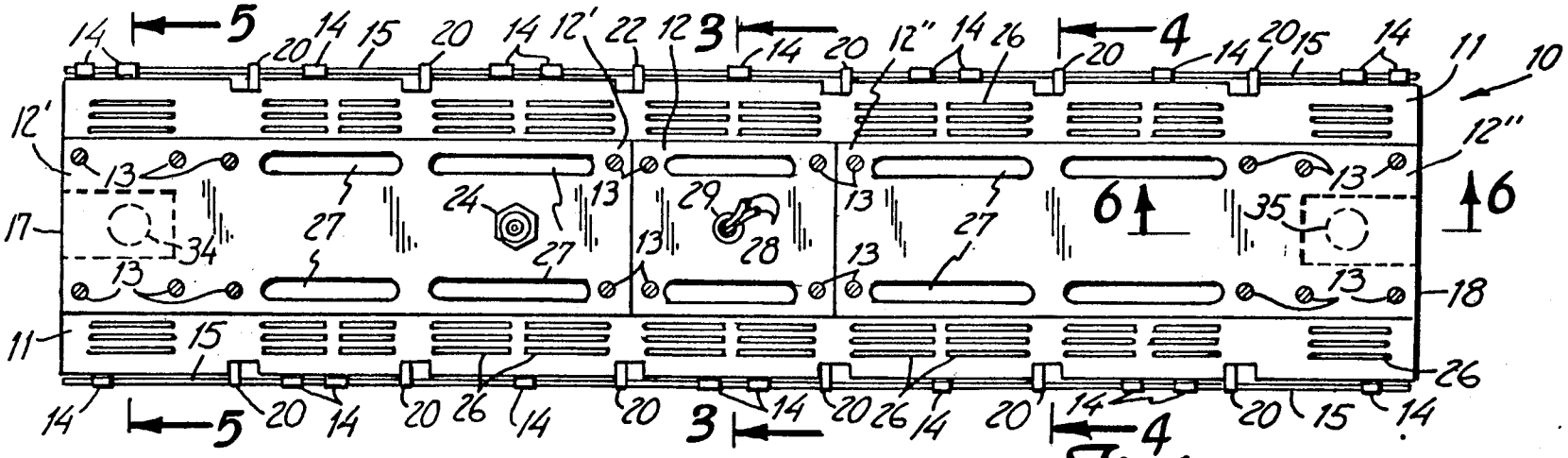
FIG. 1 shows a top plan view of a radiant energy heating unit embodying the present invention.

FIG. 1 shows a plan, or outside, view of a radiant energy heating unit easily joined with others like it in assemblages to heat selected objects of substantial complexity or size, or both. The frame, 10, of this unit for holding and operating radiant energy emitters, or lamps, therein is based on a formed sheet metal structure, 11. Sheet metal structure 11 has three cover plates, 12, 12' and 12'', fastened thereto by sheet metal screws, 13.

Sheet metal structure 11 has a series of tabs, 14, formed at the outer edges of its two long sides into first parts, or one side, of a corresponding hinge through each of them formed or curled about a corresponding pivot rod, 15. Note that the tabs 14 on either side of sheet metal structure occur in locations directly across from locations on the opposite side thereof that are devoid of tabs. The pattern on each side is to have a pair of tabs 14 relatively close together in two locations on that side and, across from the location therebetween on the opposite side, a single tab at that location which has a width that is less than the separation between the pair of tabs on the initial side.

As a result, a second frame substantially identical to frame 10 can in effect be hinged to frame 10 on a common pivot rod if such a second frame is oriented in the same manner as the first. In that arrangement, each single tab of the second frame on one side thereof can be positioned between a pair of tabs on frame 10, and vice versa, to form second hinge parts from the sheet metal structure in the second frame or the second side of the common hinge. Thus, a hinge is completed about one of pivot rods 15 by having the corresponding ones of tabs 14 from the sheet metal structure of frame 10 curled therearound, and by having the corresponding tabs of the sheet metal structure of a second frame also curled therearound but interleaved with tabs 14 from frame 10. Such a hinge can be assembled from the separated frames by inserting pivot rod 15 through the corresponding sets of tabs from frame 10, and the corresponding tabs from the second frame, and can thereafter be disassembled by removing that rod 15 from within such curled tabs.

Figure 2:
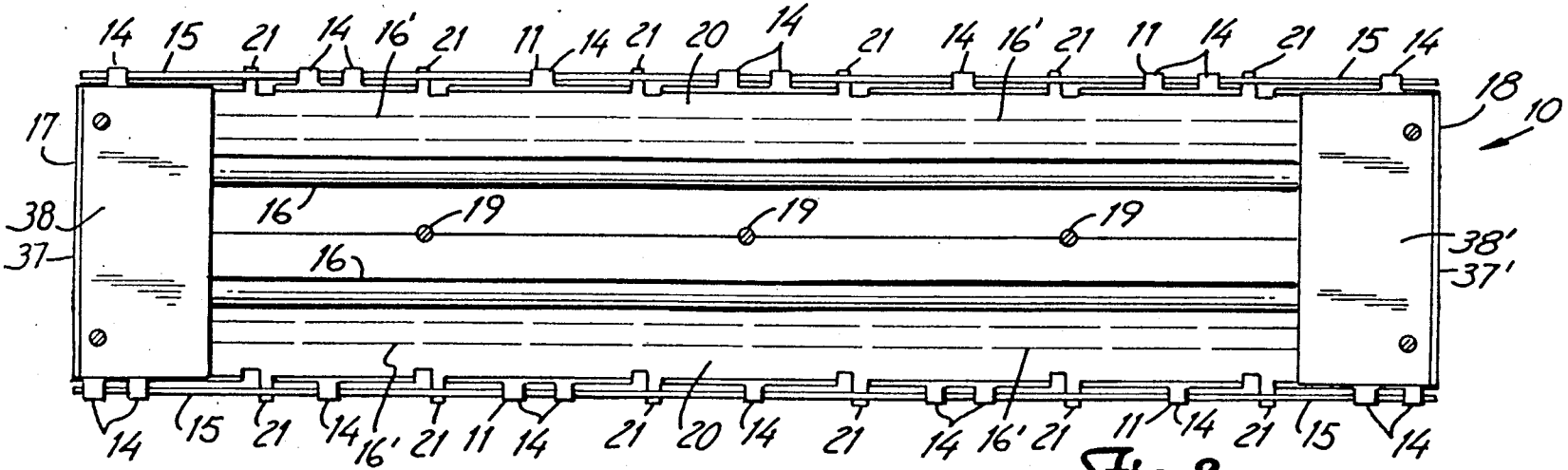
FIG. 2 shows a bottom plan view of the unit of FIG. 1.

FIG. 2 shows a plan view from the inner side of frame 10, and perhaps more clearly shows tabs 14 formed or curled about pivot rods 15. FIG. 2 also shows the primary interior space formed by the sides of sheet metal structure 11 which is to contain the radiant energy sources supplying radiant energy which is to radiate outward from the side of frame 10, shown in FIG. 2, to be transferred to an object selected for heating. As radiant energy sources in this source space, there is shown in FIG. 2 a pair of quartz tube emitters, 16, each of which has a nichrome wire spirally wound on the interior surface of its quartz tube as a source of relatively long wavelength infrared radiation. The ends of these quartz tube emitters are mounted in a pair of tube holders, 17 and 18, which are positioned in the opposite ends of the primary interior space formed by sheet metal structure 11 in FIG. 2.

Between tubes 16 are shown the heads of three sheet metal screws, 19, which hold in place along one side thereof a pair of reflectors, 20. The opposite side of each of reflectors 20 is held in place by a set of tabs, 21, extending therefrom and positioned between the corresponding one of pivot rods 15 and sheet metal structure 11. Once again, each of those tabs 21 in locations along the side of one of reflectors 20 is directly across from a location on the opposite side of the other reflector which is devoid of such a tab. Hence, similar tabs from a corresponding one of the reflectors in a second frame which has been hinged with frame 10 along a common one of pivot rods 15 will not be in conflict with tabs 21 of frame 10 along that same one of pivot rods 15. Nevertheless, reflectors 20 are each identical to one another in the geometrical shapes of each so that they are interchangeable with one another. Reflectors 20 may be made of a variety of different materials including polished aluminum and, for higher temperatures, gold covered ceramic.

Reflectors 20 each have a concave surface facing toward the observer in FIG. 2 so that, if mounted in the primary interior space between the sides of sheet metal 11 in the manner described above, they come together and form a surface which has a cross section, perpendicular to tubes 16, that substantially follows a parabola. This comes about because the configuration of sheet metal structure 11 beneath cover plates 12, 12' and 12'' is such that a channel enclosure structure is provided about a channel space beneath these covers, this channel enclosure structure being engaged by fasteners 19 holding the edges of the inner sides of reflectors 20 thereagainst. The channel enclosure portion of sheet metal structure 11 extends toward the viewer in FIG. 2 to a greater extent than portions of sheet metal structure 11 between this enclosure structure and the outer sides of structure 11 at which pivot rods 15 are located. This inward extent of the channel enclosure structure is sufficient to position these inner side edges of reflectors 20 correctly to form the reflectors' concave surface cross section parabola mentioned above.

Figure 3:
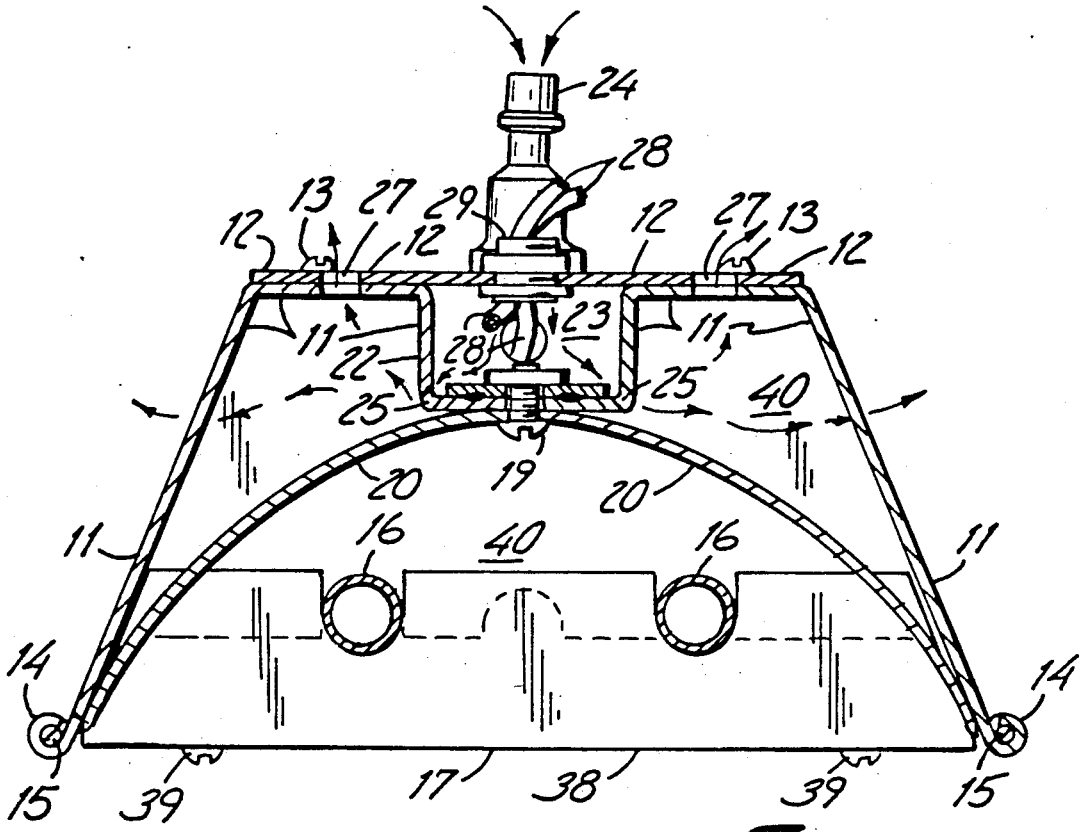
FIG. 3 shows a cross section view of the unit of FIG. 1.

This can be more clearly seen in the cross section view taken of frame 10 in FIG. 1, the first of which is shown in FIG. 3. The cross section view of sheet metal structure shows it to have an upper central portion, 22, which has two side walls and a bottom to form a channel enclosure structure enclosing a channel space, 23, on three sides. The portion of channel space 23 shown is covered on its fourth side by cover plates 12 and 12'. As can be seen, the bottom of channel enclosure structure 22 is below the adjacent portions of sheet metal structure 11 sufficiently to properly position reflectors 20 fastened thereto by threaded fastener 19 extending through the bottom of channel enclosure structure 22. As result, the inner edges of each of reflectors 20 are held by threaded fastener 19 against the bottom of channel enclosure structure 22 such that the concave surfaces of each of those reflectors come together to substantially form a parabola in cross section.

This surface contour, and the positioning of quartz tube emitters 16 with respect thereto, leads an observer seeing a pair of images, 16', of those tubes in these reflectors when facing them as in FIG. 2. This tends to result in a somewhat more uniform distribution of radiant emission sources across the opening in sheet metal structure 11 between the edges thereof at which pivot rods 15 are located. Thus, there is a somewhat more uniform transfer of radiation through this opening from emitters 16 because of these images.

Further seen in FIG. 3 are the relationships of tabs 14 of sheet metal structure 11 as curled about pivot rods 15. As can be seen on the left, the section view in FIG. 3 does not pass through the left-hand tab so that it can be seen uncut in that view. On the other hand, this section view does pass through the right-hand tab in that figure thereby indicating that the left-hand and right-hand ones of tabs 14 shown in FIG. 3 are not directly across from one another.

Figure 4:
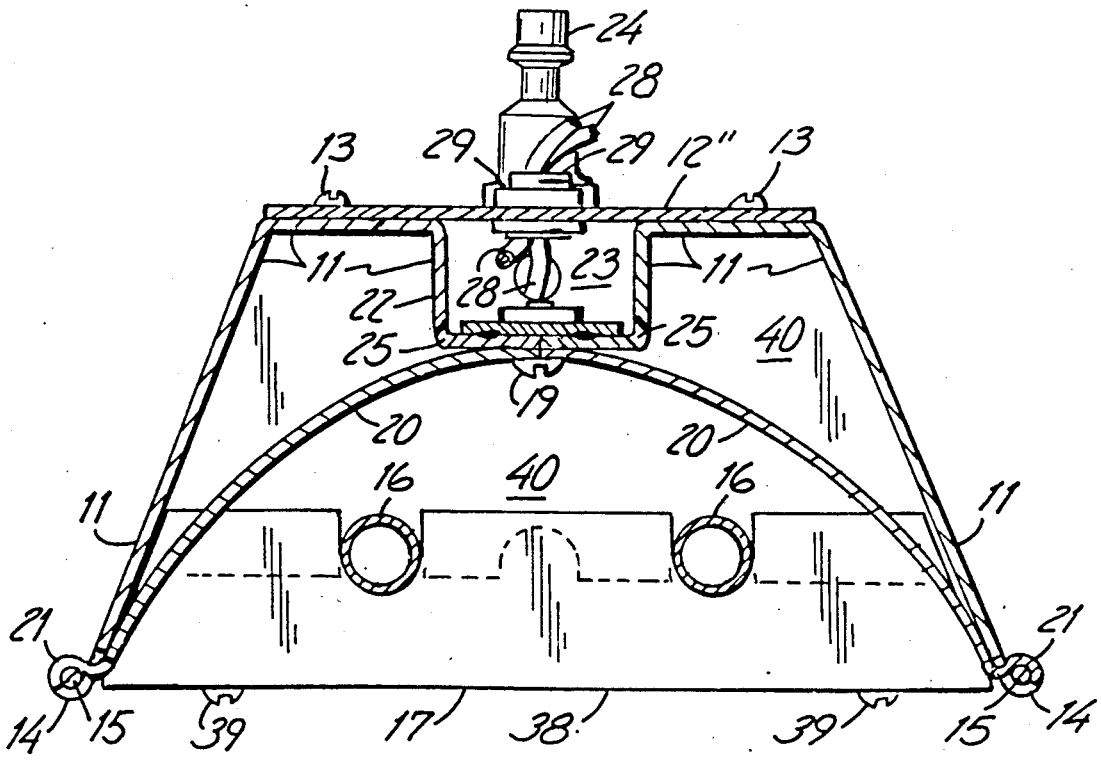
FIG. 4 shows a cross section view of the unit of FIG. 1.

FIG. 4 shows a similar situation for left-hand and right-hand tabs 21 extending from the corresponding ones of reflectors 20. That is, the cross section view taken in FIG. 4 does not pass through the left-hand one of tabs 21 shown there, but does pass through the right-hand one of those tabs shown there. Again, this confirms that tabs 21 are not directly across from one another.

Channel space 23 is provided not only to serve to position reflectors 20 properly, but also to serve both as a conduit for electrical wiring and as a plenum for a gaseous coolant for purposes of distribution thereof. In this latter service, a gaseous coolant such as air can be supplied at a fitting, 24, for introduction into channel space 23 under pressure. This coolant then escapes through multiple perforations, 25, extending through the sides of channel enclosure structure 22, i.e. through sheet metal structure 11. There, the coolant flows past the sides of reflectors 20, thereby cooling them, and then out venting openings, 26, in sheet metal structure 11 which can be best seen in FIG. 1. Some of the coolant gas also escapes through assembly structuring openings, 27, also best seen in FIG. 1. This flow can be used to markedly reduce the temperature of reflectors 20 from what it would otherwise be in those situations in which too high a temperature thereat might otherwise occur.

Electrically connecting frame 10 to a source of electrical power is accomplished by extending electrical wiring, 28, to frame 10 from such a source which is introduced therein through an electrical coupling, 29, providing an access into channel enclosure space 23, as can be seen in FIG. 3 and also in FIG. 1. From there, wiring 28 extends through part of channel space 23 and through an opening in the side of tube holder 17 to an electrical terminal in an insulated terminal stud, 30, shown in the cross section view of FIG. 4 taken from FIG. 1. From there, connections can be made to each of the quartz tube emitters 16 by electrical wires, 31 and 32, extending therefrom and shown partially in dashed line form in FIG. 4 as are the locations of emitters 16. A further electrical terminal insulated stud, 33, is also provided in tube holder 17 to accommodate electrically connecting tube 16 in either a parallel or series relationship with one another. Similar electrical terminal insulated studs are provided in tube holder 18 as an alternative, or as a supplement, for these same purposes.

Alternatively, wiring 28 could have been introduced into both tube holders 17 and 18, and channel space 23, through a "knockout", 34, in cover 12' and tube holder 17 or another "knockout", 35, in cover 12" and tube holder 18 below each of which a rectangular opening has been provided in sheet metal structure 11 shown in dashed lines in FIG. 1 through eliminating channel enclosure structure 22 at those locations.

Figure 5:
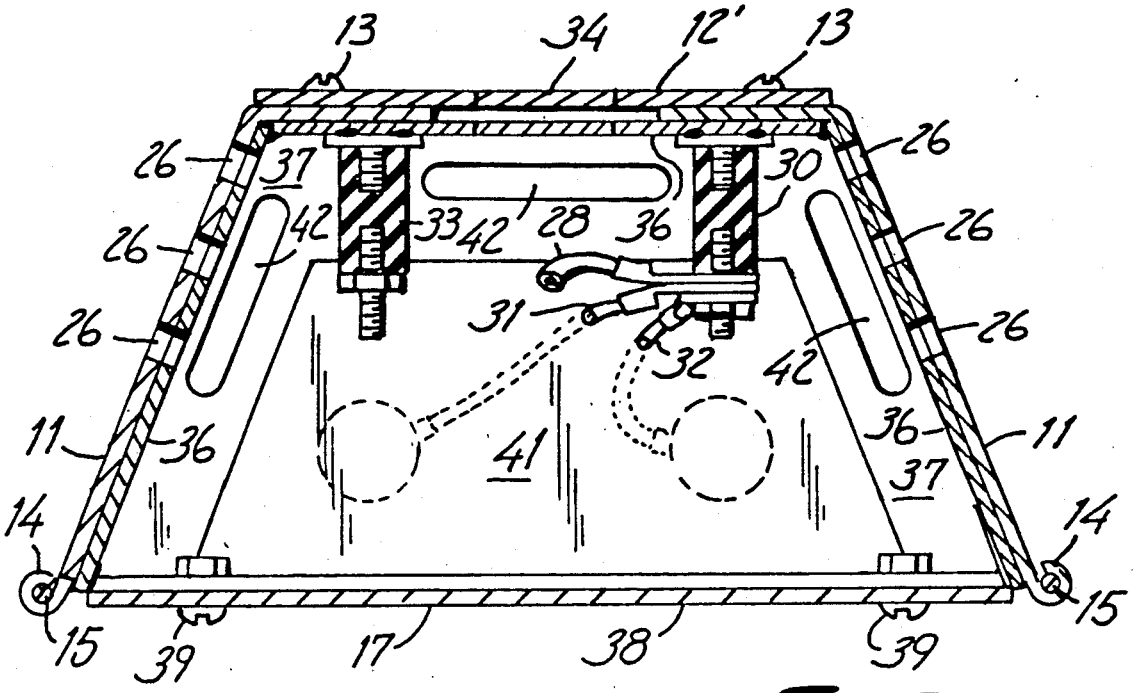
FIG. 5 shows a cross section view of the unit of FIG. 1.

Tube holder 17, in FIG. 5, is formed of a three-walled structure, 36, with an end cover, 37. A removable access plate, 38, held by a pair of fasteners, 39, clamps or constrains quartz tube emitters 16 in a pair of "U"-shaped openings against a further reflector plate, 40, to prevent tubes 16 from moving significantly in directions perpendicular to the axes thereof.

Figure 6:
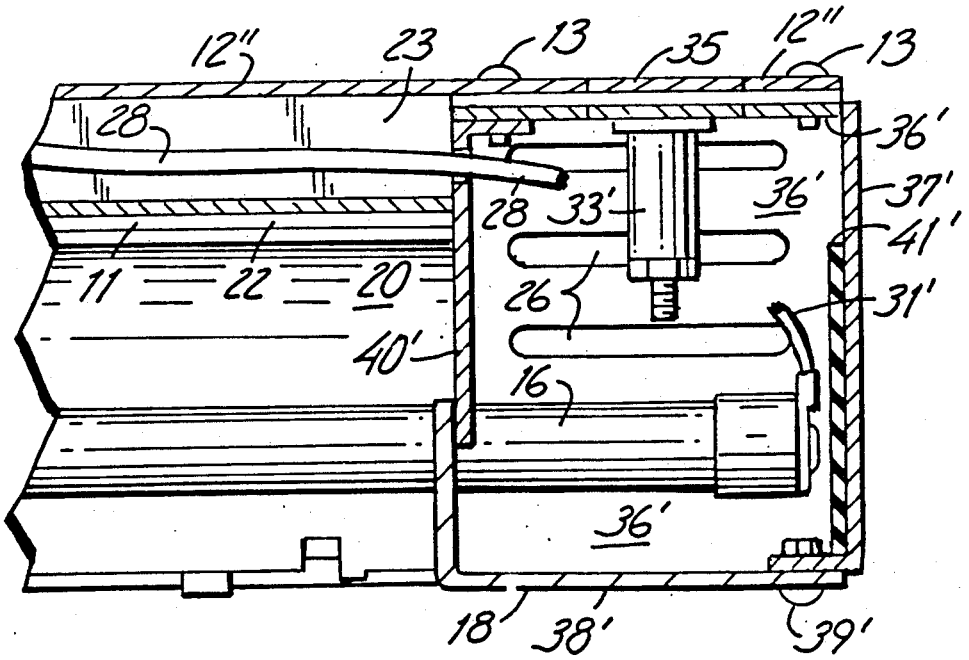
FIG. 6 shows a cross section view of the unit of FIG. 1.

A constraint on the possible axial motion of tubes 16 is provided by end cover 37 through an electrical insulating panel, 41, affixed to the inside of that end cover. This is more clearly seen in FIG. 6 which is a cross section view primarily of tube holder 18 taken from FIG. 1. The structure in tube holder 18 is a duplicate of that in tube holder 17, and so the structural members therein are given the same designations there that similar structures are given in tube holder 17 but with a prime mark added thereafter. As can be seen in FIG. 6, a very small gap exists between insulating panel 41' and the end of tube 16 with electrical wire 31' extending therefrom. A similar situation exists in tube holder 17. Thus, slight axial motion of tube 16 can occur as that tube is tipped away from true horizontal until it closes the gap with either of insulating panels 41 or 41'. Note in FIG. 5 that further assembly structuring openings, 42, are provided in end cover 37, and similar openings are also provided in end cover 37'.

As indicated above, quartz tube emitters 16 are chosen when a relatively longer infrared wavelength is suitable for the radiant heating process being undertaken. The unsealed quartz tubes in these emitters have an electrical resistor wound on the interior thereof, as indicated above, and are open to the atmosphere since they operate at relatively lower temperatures. Such units can be obtained which operate from approximately a third of a kilowatt to over four kilowatts, and at various voltages up to 480 volts.

Alternatively, some radiant heater operations require infrared radiation of a shorter wavelength. This is often supplied by the use in frame 10 of a single quartz tube tungsten filament lamp. That filament is centered and sealed in the quartz tube which in turn is filled with an inert gas such as argon, and so can be operated at significantly higher temperatures.

Figure 7:
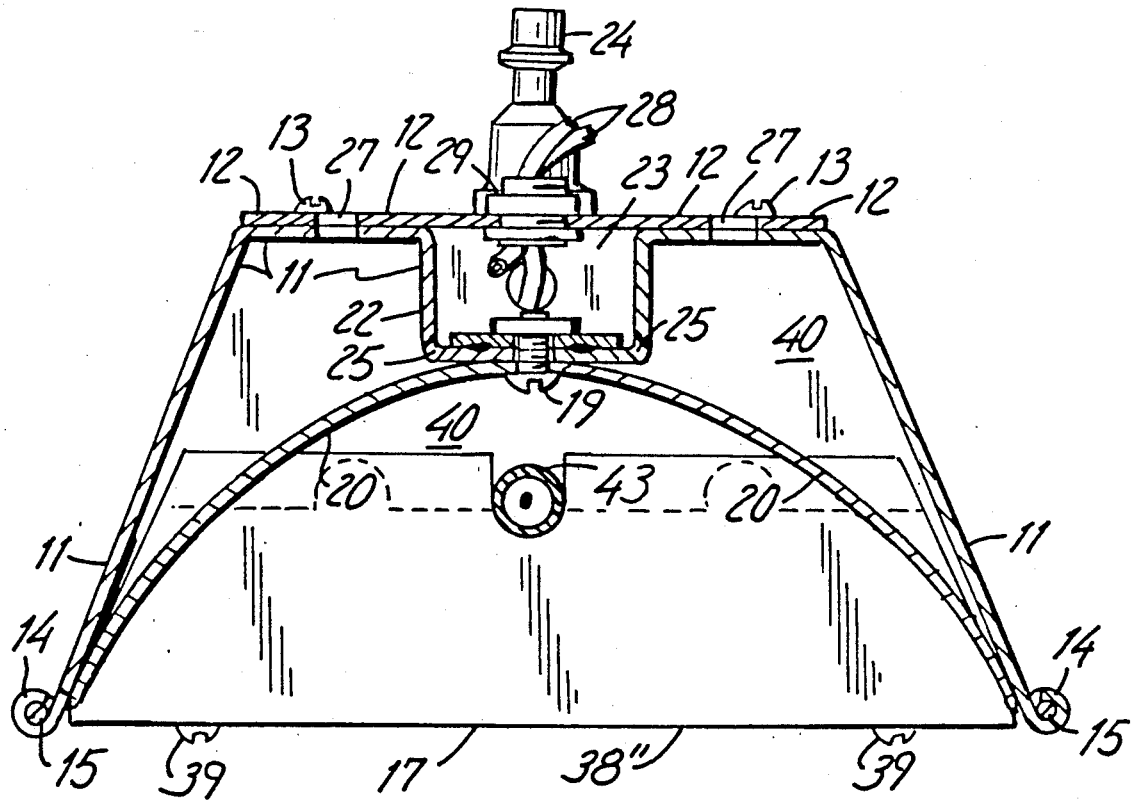
FIG. 7 shows a cross section view of a unit similar to the unit of FIG. 1 but with an alternative radiant energy source therein.

Use of such a tungsten filament lamp is shown in FIG. 7 which is a cross section view that would be the alternative to that shown in FIG. 3 if such a lamp were used in frame 10 instead of emitters 16. In FIG. 7, everything remains the same except for the modified removable access plate which has been instead provided with a single "U"-shaped opening to accommodate such a lamp, 43. As a result, this removable access plate in FIG. 7 has been designated 38". Reflector 40 is provided with openings to accommodate both emitters 16 and lamp 42. Thus, changing from emitters 16 to lamp 42, and vice versa, is relatively easy.

Figure 8:
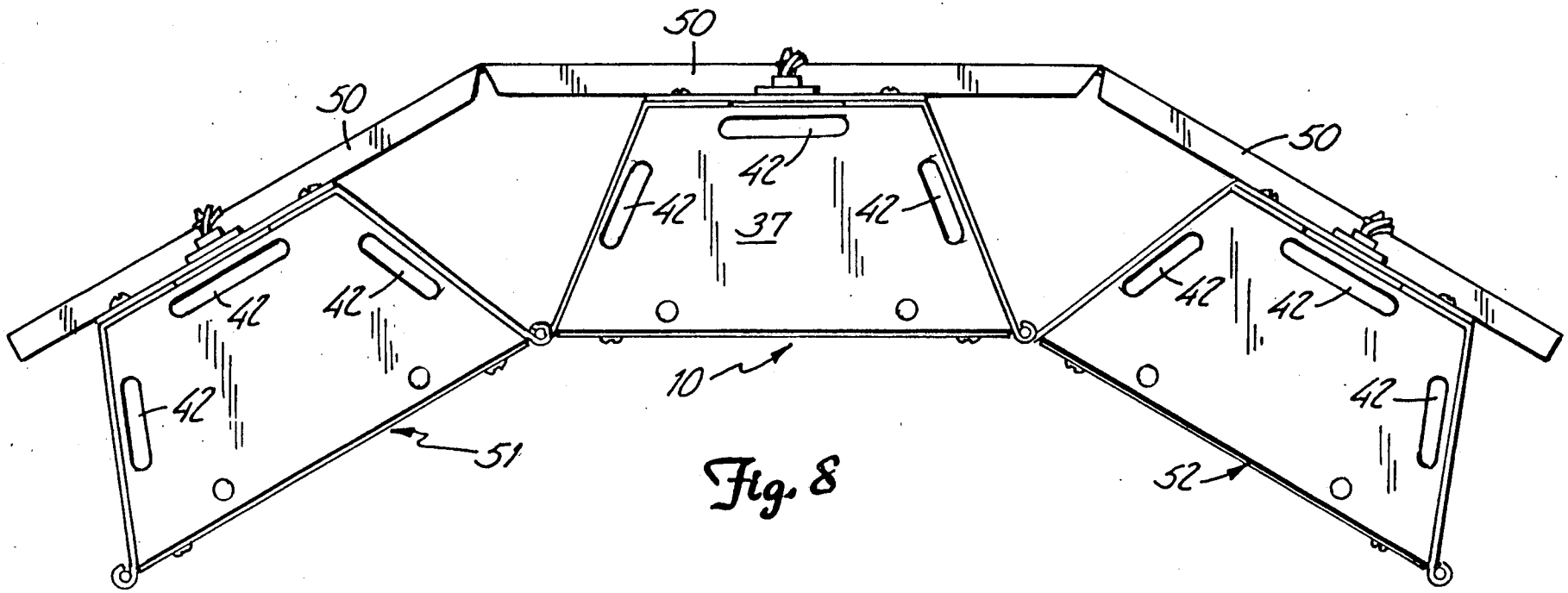
FIG. 8 shows an assemblage of units substantially like that of FIG. 1.

FIG. 8 shows assembling three radiant heating frames at selected angles with respect to one another through the use of a strut, 50. Frame 10 is hinged with two further such frames, 51 and 52. The connections are made to strut 50 from frames 10, 51 and 52 through providing fasteners in assembly structuring openings 27 in frame 10, and similar openings in frames 51 and 52. Strut 50, and a similar one directly behind it toward the opposite ends of frames 10, 51 and 52, can be easily removed from these frames should another configuration of them be desired. The hinging of these frames together, maintained at selected angles set by strut 50, provides a relatively rigid, but quickly disassembled, heating arrangement.

Figure 9:
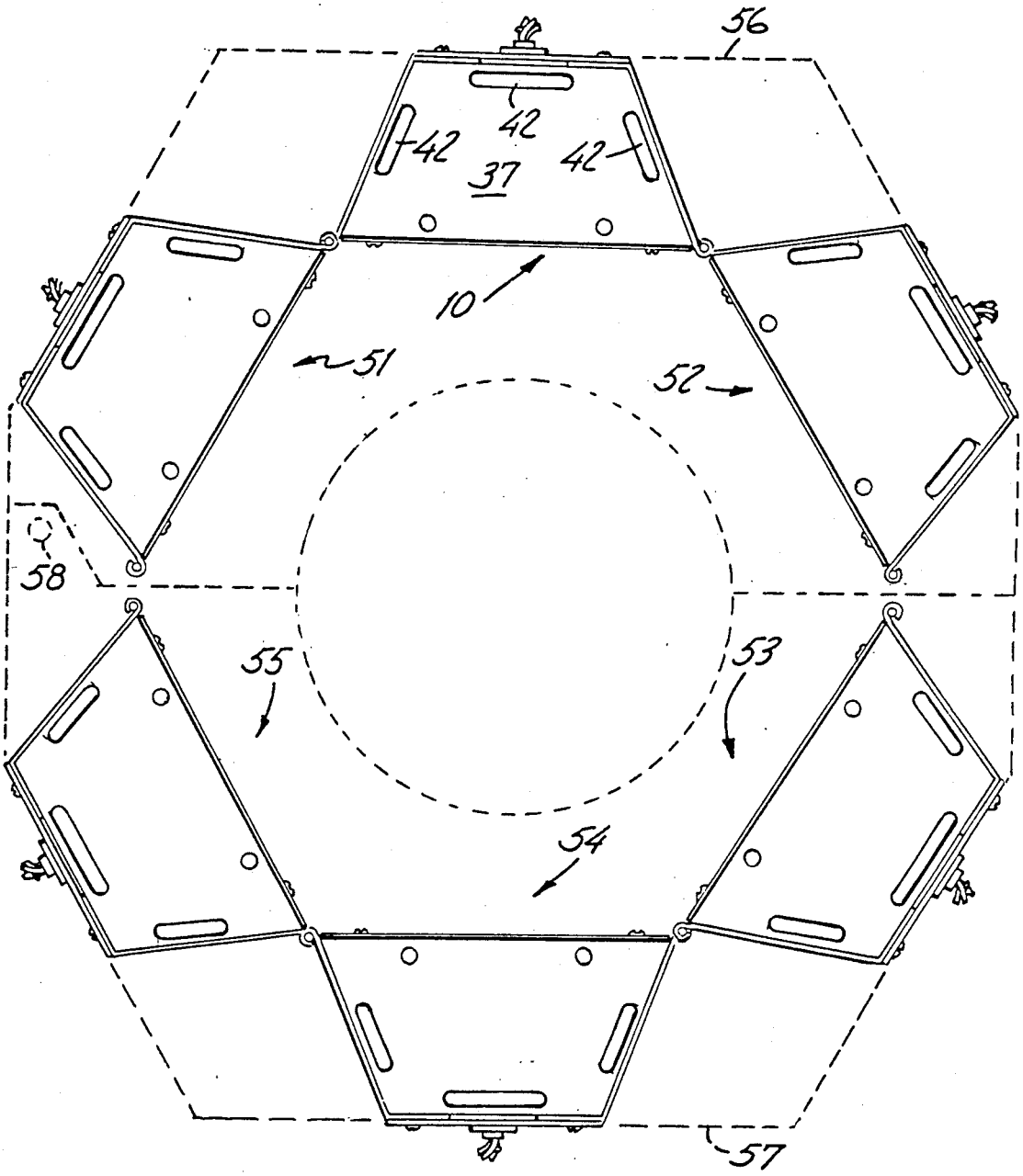
FIG. 9 shows an alternative assemblage of units substantially like that of FIG. 1.

Another alternative is shown in FIG. 9 which can result in a "clam shell" type of heating arrangement. Three additional heating frames, 53, 54 and 55, are shown with all six of them being maintained about and nearly enclosing a central heating area. They are so maintained by the provision of a pair of end plates, 56 and 57, shown in dashed line form in FIG. 9, connected to one another by a pivot pin, 58. Frames 10, 51 and 52 are maintained at selected angles with respect to one another by having end plate 56 attached to each through assembly structuring openings 42 in frame 10, and similar openings in frames 51 and 52. A similar arrangement is used with frames 53, 54 and 55 with end plate 57. By swinging open end plates 56 and 57 about pivot 58, access can be gained to the central heating space to insert or remove an object to be heated. Improved rigidity of the structure can be obtained through providing similar end plates at the opposite end of the frames shown in FIG. 9.

Although the present invention has been described with reference to preferred embodiments, workers skilled in the art will recognize that changes may be made in form and detail without departing from the spirit and scope of the invention.

What is claimed is:

1. A radiant heating structure for use in supplying radiant energy to a selected object, said structure comprising:

a first frame means having a first sheet means with both an inner surface and an outer surface on opposite sides thereof such that said outer surface at a channel enclosure portion of said first sheet means encloses an elongated channel space about either side of an access opening providing access thereto, and such that said inner surface encloses an elongated source space about either side of a transfer opening between a pair of side edge regions at opposite sides of said first sheet means, said pair of side edge regions of said first sheet means each having first portions of a corresponding hinge means provided thereat;

a first pair of reflector means each of which is removably positioned substantially in said first sheet means source space between a corresponding one of said pair of side edge regions of said first sheet means and said channel enclosure portion of said first sheet means, said first pair of reflectors so positioned forming a radiant energy reflecting surface facing said first sheet means transfer opening; and a first pair of radiant energy tube holders positioned at opposite ends of said first sheet means in said first sheet means source space each capable of constraining a radiant energy tube therein to prevent substantial motion thereof in at least one direction.

2. The apparatus of claim 1 wherein each said first hinge portion at one of said pair of side edge regions of said first sheet means is rotatably secured to a corresponding one of a pair of pivot means.

3. The apparatus of claim 1 wherein any of said first hinge portions at one of said pair of side edge regions of said first sheet means is offset from any of said first hinge portions at that one remaining of said pair of side edge regions of said first sheet means across said first sheet means transfer opening.

4. The apparatus of claim 1 wherein a first pair of electrical terminal means are provided in said first pair of radiant energy tube holders each of which is adapted for electrical connection to a radiant energy tube and to a source of voltage, said first sheet means channel space having a passageway provided therefrom to each of said first pair of electrical terminals.

5. The apparatus of claim 1 whrein each of said first pair of radiant energy tube holders has a first constraint plate with three openings therein each intersecting an edge thereof and a selected one of two removable second constraint plates each with less than three openings therein that intersect an edge thereof though differing from one another in total, said first and second constraint plates together being capable of constraining at least one radiant energy tube therebetween against substantial motion in a direction substantially perpendicular to an axis of elongation of such a radiant energy tube.

6. The apparatus of claim 1 wherein said first sheet means is perforated with ventilation openings.

7. The apparatus of claim 1 wherein said first pair of reflector means, in each being positioned at said channel enclosure portion of said first sheet means, are each maintained there by a fastener means which removably engages said first sheet means channel enclosure portion at said first sheet means inner surface.

8. The apparatus of claim wherein there is provided a first cover means which can be fastened over said access opening to said first sheet means channel space and which has a first fitting therein adapted to receive a gaseous coolant from a pressurized source thereof, said channel enclosure portion of said first sheet means having perforations therein so that said coolant under pressure supplied to said first sheet means channel space can escape to at least some extent into said first sheet means source space.

9. The apparatus of claim 2 wherein said first pair of reflector means, in each being positioned at a corresponding one of said pair of side edge regions of said first sheet means, is maintained there by at least one tab extending from an edge thereof that is positioned between that said pivot means rotatably secured at that said side edge region and portions of said first sheet means.

10. The apparatus of claim 2 wherein said structure further comprises:

a second frame means having a second sheet means with both an inner surface and an outer surface on opposite sides thereof such that said outer surface at a channel enclosure portion of said second sheet means encloses an elongated channel space about either side of an access opening providing access thereto, and such that said inner surface encloses an elongated source space about either side of a transfer opening between a pair of side edge regions at opposite sides of said second sheet means, said pair of side edge regions of said second sheet means each having second portions of a corresponding hinge means provided thereat with one of said pair of side edge regions of said second sheet means having said second hinge portions thereat rotatably secured to a selected one of said pair of pivot means;

a second pair of reflector means each of which is removably positioned substantially in said second sheet means source space between a corresponding one of said pair of side edge regions of said second sheet means and said channel enclosure portion of said second sheet means, said second pair of reflectors so positioned forming a radiant energy reflecting surface facing said second sheet means transfer opening; and a second pair of radiant energy tube holders positioned at opposite ends of said second sheet means in said second sheet means source space each capable of constraining a radiant energy tube therein to prevent substantial motion thereof in at least one direction.

11. The apparatus of claim 4 wherein there is provided a first cover means which can be fastened over said access opening to said first sheet means channel space, said first cover means having a first opening therein which can receive wiring extending from a source of voltage.

12. The apparatus of claim 9 wherein any said tabs extending from said edge of one of said first pair of reflector means is offset from any said tabs extending from said edge of that one remaining of said first pair of reflector means across said first sheet means transfer opening but with each of said first pair of reflector means being of substantially identical shape.

13. The apparatus of claim 10 wherein any of said first hinge portions at one of said pair of side edge regions of said first sheet means is offset from any of said first hinge portions at that one remaining of said pair of side edge regions of said first sheet means across said first sheet means transfer opening, and wherein any of said second hinge portions at one of said pair of side edge regions of said second sheet means is offset from any of said second hinge portions at that one remaining of said pair of side edge regions of said second sheet means across said second sheet means transfer opening, said first and second sheet means being of substantially identical shape as are said first and second hinge portions at corresponding ones of said first and second pairs of side edge regions.

14. The apparatus of claim 10 wherein said first and second frame means are rotated about said selected one of said pair of pivot means to be at a selected angle with respect to one another and fixed there by an end plate secured to one of said first pair of radiant energy tube holders and to one of said second pair of radiant energy tube holders.

15. The apparatus of claim 10 wherein said first and second frame means are rotated about said selected one of said pair of pivot means to be at a selected angle with respect to one another and fixed there by a strut means secured to each of said first and second sheet means at said outer surfaces thereof.

16. The apparatus of claim 10 wherein a first pair of electrical terminal means are provided in said first pair of radiant energy tube holders each of which is adapted for electrical connection to a radiant energy tube and to a source of voltage, said first sheet means channel space having a passageway provided therefrom to each of said first pair of electrical terminals; and wherein a second pair of electrical terminal means are provided in said second pair of radiant energy tube holders each of which is adapted for electrical connection to a radiant energy tube and to a source of voltage, said second sheet means channel space having a passageway provided therefrom to each of said second pair of electrical terminals.

17. The apparatus of claim 10 wherein both said first and second sheet means are perforated with ventilation openings.

18. The apparatus of claim 10 wherein said first pair of reflector means, in each being positioned at said channel enclosure portion of said first sheet means, are each maintained there by a fastener means which removably engages said first sheet means channel enclosure portion at said first sheet means inner surface; and wherein said second pair of reflector means, in each being positioned at said channel enclosure portion of said second sheet means, are each maintained there by a fastener means which removably engages said second sheet means channel enclosure portion at said second sheet means inner surface.

19. The apparatus of claim 10 wherein there is provided a first cover means which can be fastened over said access opening to said first sheet means channel space and which has a first fitting therein adapted to receive a gaseous coolant from a pressurized source thereof, said channel enclosure portion of said first sheet means having perforations therein so that said coolant under pressure supplied to said first sheet means channel space can escape to at least some extent into said first sheet means source space, and wherein there is provided a second cover means which can be fastened over said access opening to said second sheet means channel space and which has a second fitting therein adapted to receive a gaseous coolant from a pressurized source thereof, said channel enclosure portion of said second sheet means having perforations therein so that said coolant under pressure supplied to said second sheet means channel space can escape to at least some extent into said second sheet means source space.

20. The apparatus of claim 10 wherein said first pair of reflector means, in each being positioned at a corresponding one of said pair of side edge regions of said first sheet means, is maintained there by at least one tab extending from an edge thereof that is positioned between that said pivot means rotatably secured at that said side edge region and portions of said first sheet means; and wherein one of said second pair of reflector means, in being positioned at that one of said pair of side edge regions of said second sheet means having said second hinge portions thereat secured to said selected one of said pair of pivot means, is maintained there by at least one tab extending from an edge thereof that is positioned between that said pivot means and portions of said second sheet means.

21. The apparatus of claim 11 wherein said first cover means has a first fitting therein adapted to receive a gaseous coolant from a pressurized source thereof, said channel enclosure portion of said first sheet means having perforations therein so that said coolant under pressure supplied to said first sheet means channel space can escape to at least some extent into said first sheet means source space.

22. A radiant heating structure for use in supplying radiant energy to a selected object, said structure comprising:

a first frame means having a first sheet means with both an inner surface and an outer surface on opposite sides thereof such that said outer surface at a channel enclosure portion of said first sheet means encloses an elongated channel space about either side of an access opening providing access thereto, and such that said inner surface enclosed an elongated source space about either side of a transfer opening between a pair of side edge regions at opposite sides of said first sheet means;

a first pair of reflector means each of which is removably positioned substantially in said first sheet means source space between a corresponding one of said pair of side edge regions of said first sheet means and said channel enclosure portion of said first sheet means, said first pair of reflectors so positioned forming a radiant energy reflecting surface facing said first sheet means transfer opening; and a first pair of radiant energy tube holders positioned at opposite ends of said first sheet means in said first sheet means source space each capable of constraining a radiant energy tube therein to prevent substantial motion thereof in at least one direction.

23. The apparatus of claim 22 wherein each of said first pair of radiant energy tube holders has a first constraint plate with three openings therein each intersecting and edge thereof and a selected one of two removable second constraint plate each with less than three openings therein that intersect an edge thereof though differing from one another in total, said first and second constraint plates together being capable of constraining at least one radiant energy tube therebetween against substantial motion in a direction substantially perpendicular to an axis of elongation of such a radiant energy tube.

24. The apparatus of claim 22 wherein said first pair of reflector means, in each being positioned at said channel enclosure portion of said first sheet means, are each maintained there by a fastener means which removably engages said first sheet means channel enclosure portion at said first sheet means inner surface.

25. The apparatus of claim 22 wherein there is provided a first cover means which can be fastened over said access opening to said first sheet means channel space and which has a first fitting therein adapted to receive a gaseous coolant from a pressurized source thereof, said channel enclosure portion of said first sheet means having perforations therein so that said coolant under pressure supplied to said first sheet means channel space can escape to at least some extent into said first sheet means source space.

26. The apparatus of claim 22 wherein there is provided a first cover means which can be fastened over said access opening to said first sheet means channel space, said first cover means having a first opening therein which can receive wiring extending from a source of voltage.

* * * * *

UNITED STATES PATENT AND TRADEMARK OFFICE

CERTIFICATE OF CORRECTION

PATENT NO. : 5,049,725

DATED : September 17, 1991

INVENTOR(S) : Andrew E. Abramson

It is certified that error appears in the above-identified patent and that said Letters Patent is hereby corrected as shown below:

Col. 7, line 25, delete "whrein" and insert --wherein--.

Col. 7, line 45, delete "claim" and insert --claim 1--.

Signed and Sealed this

Sixteenth Day of March, 1993

*Attest:*

STEPHEN G. KUNIN

*Attesting Officer*

*Acting Commissioner of Patents and Trademarks*